US005307567A

United States Patent [19]

Schnake et al.

[11] Patent Number: 5,307,567

[45] Date of Patent: May 3, 1994

[54] HORIZONTALLY-SPINNING AND HORIZONTAL LOADING CENTRIFUGE AND METHOD FOR DE-WATERING BULK MATERIALS IN LARGE VOLUMES

[75] Inventors: John L. Schnake, Morgan Hill; Gordon D. Frye, San Jose, both of Calif.

[73] Assignee: Controls Systems & Mechanics International, Los Gatos, Calif.

[21] Appl. No.: 28,297

[22] Filed: Mar. 9, 1993

[51] Int. Cl.[5] ..... F26B 5/08

[52] U.S. Cl. ..... 34/319; 34/58; 34/182; 494/84

[58] Field of Search ..... 34/8, 58, 133 F, 133 G, 34/133 H, 180–184, 236, 135; 494/36, 84; 210/360.1, 403

[56] References Cited

U.S. PATENT DOCUMENTS

| | | | |
|---|---|---|---|
| 2,026,189 | 12/1935 | Purkett | 34/133 F |
| 3,313,034 | 4/1967 | Meyer | 34/58 |
| 4,426,794 | 1/1984 | Vanderheijden | 34/133 F |
| 4,961,274 | 10/1990 | Coffman | 34/133 F |
| 4,996,780 | 3/1991 | Soul-Sun Goe | 34/58 |
| 5,027,530 | 7/1991 | Vollmer et al. | 34/58 |

OTHER PUBLICATIONS

Heinzen Manufacturing, Inc. "300-SD" sales brochure.
Gabilan Manufacturing, Inc., "low-profile" Centrifuge sales brochure.
Sanborn Model P "Fully Automatic Vegetable Spin Dryer" sales brochure.
Bock Engineered Products, Inc., "Centrifugal Food Drying" sales brochure.

*Primary Examiner*—Denise Gromada
*Attorney, Agent, or Firm*—Thomas E. Schatzel

[57] ABSTRACT

An embodiment of the present invention includes an open-ended, non-spinning housing, which is fitted with an inner lining that rotates within the housing at speeds sufficient to de-water material loaded from within and along the length of the inner liner. A loading conveyor system has a discharge end that can be relatively positioned horizontally at various depths within the inner liner to deposit product at continuously variable layer depths on the inner liner while it is spinning. Once loaded, the inner liner is accelerated to a drying speed and the housing is swiveled to vertical on gudgeons. Once drying is complete, the inner liner is slowed down, or stopped, and the de-watered product can fall out to land on an unloading conveyor.

23 Claims, 3 Drawing Sheets

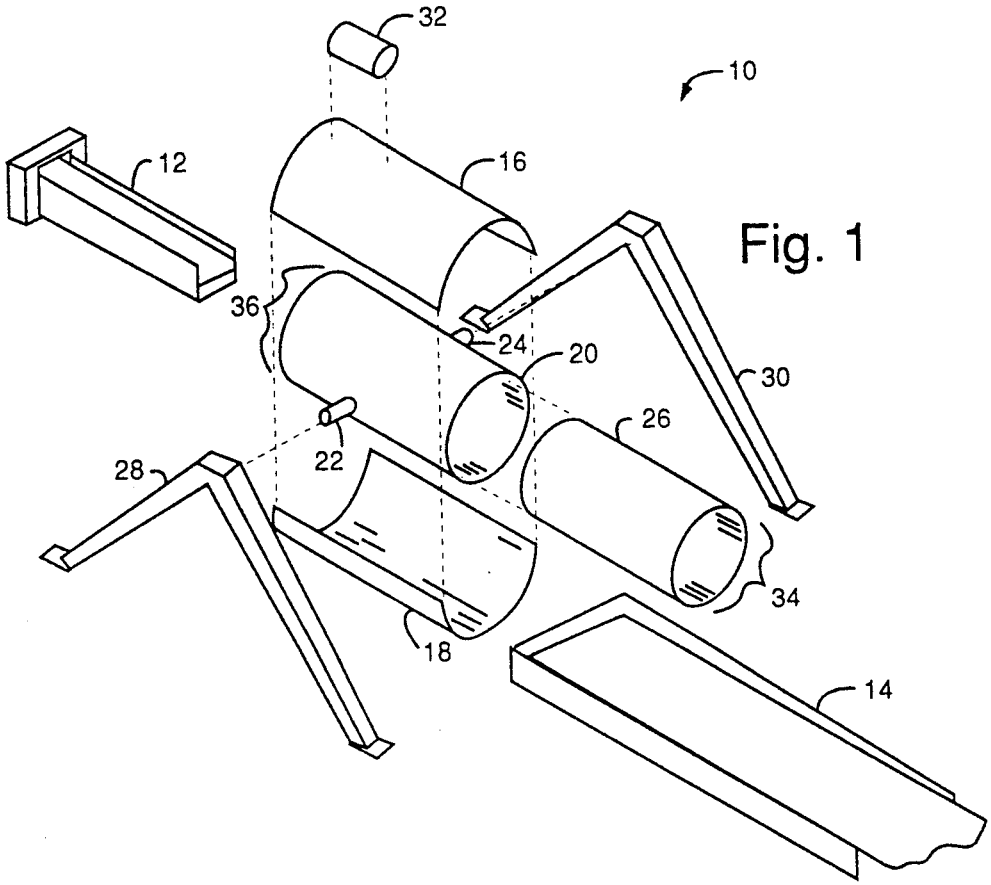
Fig. 1
Fig. 2
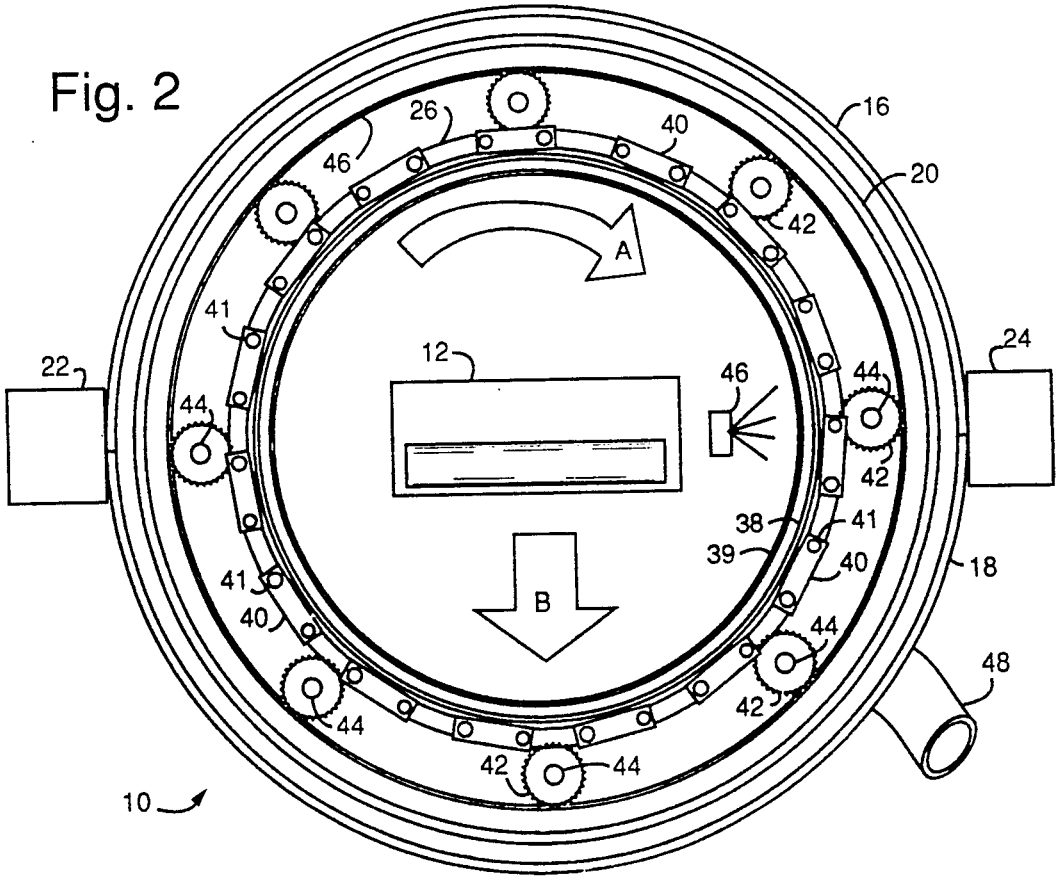

HORIZONTALLY-SPINNING AND HORIZONTAL LOADING CENTRIFUGE AND METHOD FOR DE-WATERING BULK MATERIALS IN LARGE VOLUMES

RELATED DOCUMENTS

The Inventors have caused to be filed a document number 309,257, on May 4, 1992, under the Disclosure Document Program of the USPTO (MPEP §1706), which is related to the subject matter of the present invention.

BACKGROUND OF THE INVENTION

1. Field of the Invention

The present invention relates generally to centrifuge mechanisms, and more particularly to equipment for removing excess water from solids, such as de-watering leafy vegetable matter after washing and liquid-solid filtration.

2. Description of the Prior Art

Centrifugal food drying is currently being used to remove water from prepared salads after washing, to extract excess oil from chips and snacks, to salvage chocolate and nut meats from stale candy, to remove excess fat from meats and to extract juice and pulp from fruit. For example, Bock Engineered Products, Inc. (Toledo, Ohio) markets an "FP" series of centrifuges for dry weight capacities ranging from thirty-five pounds to 130 pounds. The Bock FP centrifuges includes a stainless steel basket, lid and cover. A fluid drive power transfer system spins the basket on a vertical axis and is stated to be self-balancing. The units are bolted to a floor with a tripod arrangement. A high volume model, FP-90, comes with a stainless steel lifting yoke, a basket floor dolly, a waterproof timer and a grid liner. A high-volume/multi-product model, FP-900, has a basket tachometer, stainless steel base and legs, stainless steel back panel, hydrostatic variable speed control, stainless control circuit housing, stainless steel basket lifting yoke and a waterproof timer. The basket operates at a maximum of 1200 to 1700 revolutions per minute, depending on the manufacturer involved, to obtain a G-force of 600 to 980. The United States Department of Agriculture (USDA) has a program for approving such centrifuges in food processing. Operation of the Bock FP centrifuges includes a six step process.

In a first step, a hoist is used to put the basket into the centrifuge. The basket pins are checked to see that they are securely seated into the lifting yoke. A second step is to load the basket evenly. An improved drying is obtainable by placing a back-up grid in the basket before loading. The back-up grid can remain in place when dumping later. Leafy foods can be loaded to the top of the basket. Heavier foods, such as carrots and onions, are loaded no higher than the top of a centerpost in the basket. The maximum dry weight load is not recommended to exceed 130 pounds, and the basket can be loaded either inside or outside the machine. In a third step, the basket is guided into the machine by holding the inner rim of the basket, then unhooking and removing the yoke. In a fourth step, the inner rim of the basket is rotated by hand until firmly seated on a drive ball. The lid is closed and a start button is pressed to begin the automatic cycle. Bock cautions its users that the basket must be fully seated on the drive ball. In a fifth step, after a red indicator light goes out, the lid may be opened and the yoke is hooked to mating pins to lift the basket out. Bock cautions its users never to open the lid while the basket is moving, otherwise severe injury can result. In a sixth step, the contents of the basket are dumped by holding the inner rim and rotating the basket on the yoke.

A similar de-watering centrifuge is marketed by Gabilan Manufacturing, Inc. (Salinas, Calif.). The Gabilan unit is offered commercially for spin-drying lettuce, cabbage, spinach, onions, celery, carrots and other processed vegetables and other industrial applications. The Gabilan model GC10001p uses a three-point suspension system and a 8.9 cubic foot basket that rotates on a vertical axis within a stationary drum with a cover. Dry weight process capacity has been published by Gabilan as being 140 pounds for chopped lettuce, 175 pounds for shredded cabbage and forty pounds for whole leaf spinach. The basket operates at a maximum of 1076 revolutions per minute.

A fully automatic vegetable spin dryer is marketed by Sanborn (Wrentham, Mass.) as the SANBORN Model P. Drying applications include spinach, salad mix, cole slaw mix, shredded and chopped lettuce, shredded and chopped cabbage and related vegetables, e.g., onions, carrots, etc. The SANBORN Model P appoints itself to eliminating manual operations in the drying process by having a feed conveyer to load a spin dryer that rotates on a vertical axis, a product discharge cone that opens up the bottom of the spin dryer and a take-away conveyer system on which the product drops from the spin dryer. An inner basket is forty inches in diameter by twenty-four inches in height and is adjustably rotated up to 1100 revolutions per minute. A five step process is involved.

In a first step, a feed system controls the batch sizes and automatically loads the spin dryer, with the objective of consistent capacity from load to load. In a second step, the spin dryer operates at a low speed during the feed cycle to distribute wet product evenly around an inner basket. In a third step, the spin dryer automatically initiates the drying cycle at the end of the feed cycle. The rotational speed of the basket is increased to a drying speed and spun for a predetermined period. In a fourth step, a discharge cycle causes the spin dryer to decelerate to a "safe" unloading speed and the product discharge cone is released. The dried product falls out to the take-away conveyor. In a fifth step, the product discharge cone is raised back to its closed position and the spin dryer is re-accelerated to feeding speed, and the five-step cycle is repeated.

In general, conventional vertical centrifuges receive batches of produce to be de-watered in cylindrical perforated metal baskets. The baskets have a central female shaft hexagonal socket in the bottom which slip fits on the male hexagonal vertical drive shaft in the machine frame. The machine frame is very heavy to contain fragments should the basket breakup during the centrifuging process, as sometimes happens because of uneven loading.

The centrifuge shaft thus both supports and drives the basket, sometimes through a modified gimbals to adjust for uneven loading. The uneven loading, which run the basket out of balance, can trip a vibration safety switch, which will cut off power. The basket load of produce then must be manually redistributed before the centrifuge can accelerate to full speed for the de-watering process.

In some prior art machines there is a twin door opening bottom to discharge the de-watered produce, while in others the produce is removed by hand through the top opening of the basket. The machines are generally furnished with two or more baskets, since each one must be individually loaded, lifted, transported and set down into the centrifuge for the centrifugal operation, then lifted out and suspended over a receiving facility, where the bottom is opened for unloading. Baskets without bottom doors must be inverted to unload.

Because of their size and weight, the baskets are usually handled by overhead hoists mounted on monorails, and therefore, a typical de-watering system requires a relatively large area and several operators. Frequent repairs are necessary because of the damage sustained from uneven loading.

Since washing processes are usually continuous, elimination of the basket loading, unloading and moving requirement would both improve the process and reduce the cost. An open-ended cylinder that is spun rapidly on a horizontal axis can be used for de-watering. Uniform loading is simple and readily obtainable, and eliminates out of balance problems that can have catastrophic consequences.

A better method of de-watering washed or rinsed leafy vegetables such as lettuce or spinach is therefore needed in the vegetable drying industry.

SUMMARY OF THE INVENTION

It is therefore an object of the present invention to provide a centrifuge that is compatible with high-volume continuous processes.

It is another object of the present invention to provide a centrifuge that is readily automated.

It is a further object of the present invention to provide a centrifuge that distributes its loads uniformly to achieve a balance during spinning operations.

Briefly, an open-ended non-spinning housing is fitted with an inner lining that rotates within the housing at speeds sufficient to de-water material loaded from within and along the length of the inner liner. A product feeding system has an end that can be inserted horizontally at various depths within the inner liner to deposit product at continuously variable depths on the inner liner while it is spinning on a horizontal axis. Once loaded, the inner liner is accelerated to a drying speed and the housing is swiveled to vertical on gudgeons. Once drying is complete, the inner liner is slowed down and the de-watered product can fall out to either a take-away conveyer or trucks.

An advantage of the present invention is that a centrifuge is provided that promotes uniform loading of product within the centrifuge and thus avoids imbalance conditions.

Another advantage of the present invention is that a centrifuge is provided that eliminates any central shaft or structural frame inside the spin-drying basket.

A further advantage of the present invention is that a centrifuge is provided that is suspended on trunnions and/or rides on them between external parallel tracks.

Another advantage of the present invention is that a centrifuge is provided that avoids entrapment points where wet product could build-up in a non-uniform manner and that would adversely affect even de-watering.

An advantage of the present invention is that a centrifuge is provided in which speed control of the basket axle drive motor is provided for facilitating continuous loading at a low speed and spinning the basket and produce load at a significantly higher speed while de-watering.

A still further advantage of the present invention is that a centrifuge is provided in which fish, shrimp and other seafood products that are easily bruised can be thoroughly de-watered without damaging the products.

These and other objects and advantages of the present invention will no doubt become obvious to those of ordinary skill in the art after having read the following detailed description of the preferred embodiment which is illustrated in the various drawing figures.

IN THE DRAWINGS

FIG. 1 is a perspective view assembly diagram of a centrifuge embodiment of the present invention;

FIG. 2 is an end view of the centrifuge of FIG. 1, as seen from the unloading opening on the axis of the spin basket;

DETAILED DESCRIPTION OF THE PREFERRED EMBODIMENT

Figure 3A:
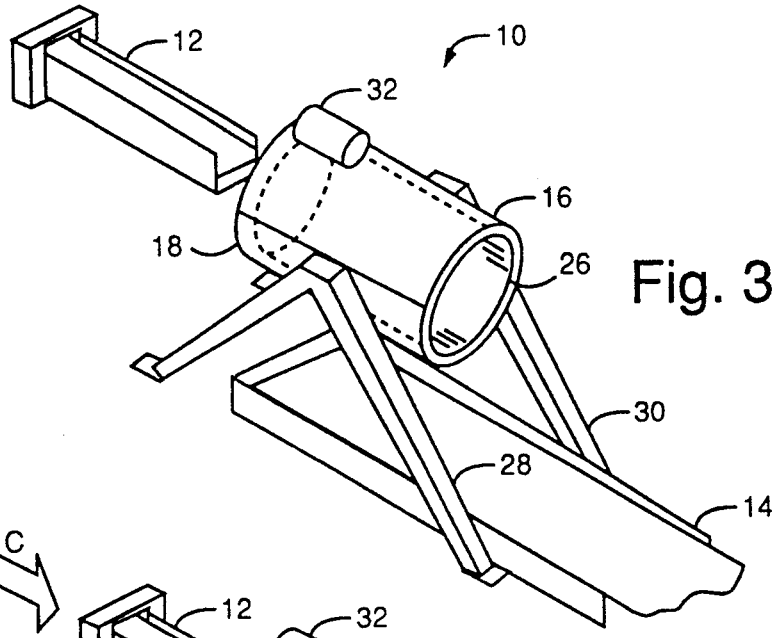
FIG. 3A is a perspective view of the centrifuge of FIG. 1 in a condition prior to loading.

FIG. 1 illustrates a centrifuge embodiment of the present invention, referred to by the general reference numeral 10. Centrifuge 10 comprises a loading conveyor 12, an unloading conveyor 14, a pair of outer liquid containment shells 16 and 18, a structural support shell 20 that is pivotal on a pair of trunnions 22 and 24, a centrifuge tube 26, a pair of support legs 28 and 30, and a motor 32 for rotating centrifuge tube 26. As an example, centrifuge tube 26 can be turned at 500 revolutions per minute (RPM), or more, and is thirty-six inches in diameter by seventy-two inches in length. Preferably, motor 32 is a variable speed type that permits operation at lower RPMs and is rated at a level that will depend on the load applications, the present inventors have had good results with ten horsepower ratings. At larger inside diameters, the maximum RPM used would necessarily be reduced to achieve a consistent centrifugal force that will sling off liquid from product at an acceptable rate. Such RPMs are typically empirically derived. Although the inventors have used a centrifuge tube 26 of thirty-six inches in diameter by seventy-two inches in length, the present invention is not limited to these particular dimensions, and each may be increased or decreased independently as the volume of product to be processed is redefined. With the exemplary dimensions suggested here, the inventors have found a product deposition depth of three inches to have produced acceptable drying results.

An unloading opening 34 is opposite to a loading opening 36. Although two openings 34 and 36 are described here, the present invention is not limited to having two oppositely positioned openings. In an alternative embodiment, only one opening is used for both loading and unloading product. In centrifuge 10, product to be de-watered is introduced through opening 36 by loading conveyor 12 and is unloaded onto unloading conveyor 14 by dropping product out through opening 34 by force of gravity.

FIG. 2 shows centrifuge 10 as viewed from opening 34 and illustrates that centrifuge 10 further comprises a plurality of hoops 38 that spread out centrifuge tube 26 and hold it in place. Alternatively, a tubular sieve 39 may be inserted within centrifuge tube 26 as an inner liner mesh to prevent product from working itself into crevices and still allow liquid to pass through. For example, a mesh with one sixteenth inch diameter holes may be used. As a second example, filter paper or cloth may be used. Cloth would be appropriate in cottage cheese manufacturing to separate the milk curds from the whey.

For clean-out of centrifuge 10, high pressure sprays may be used to flush out whatever does accumulate on the inner surfaces of containment shells 16 and 18, support shell 20 and centrifuge tube 26. Particular applications may benefit from the addition of an automatic flushing system that cleans out debris at the end of each work day or shift. Such an apparatus may be necessary to gain government approval for food processing applications of centrifuge 10.

Centrifuge tube 26 preferably comprises a webbing of plastic conveyor belt links 40 (FIG. 2) and full-length pins 41 that have been connected in a circular belt configuration to form the cylindrical tube shape of centrifuge tube 26. For example, Intralox System (New Orleans, La.) series 900 belt, with a flush grid may be used for centrifuge tube 26 or Intralox System series 800 belt, with a perforated flat top, may be used. Such belts are assembled inside-out from their conventional configuration, so that the belt may be driven from its outside rather than its inside. Such belt preferably will withstand operation at a linear velocity of 3500 feet per minute, or more. Acceptable materials include polypropylene and polyacetal, to promote USDA approval.

As shown in FIG. 2, a system of sprocket gears 42 on respective axles 44 are provided to drive centrifuge tube 26 around in a spin direction "A". Hoops 38 forcibly maintain an engagement of links 40 with sprockets 42. An outer belt 46 couples the outside edges of sprockets 42 together and evenly distributes rotational drive about the perimeter. Outer belt 46 is approximately six inches wide and comprises the same type of plastic link and pin belting used for centrifuge tube 26. Motor 32 is coupled to sprockets 42 by either a drive belt or drive chain, and is conventional, and therefore these are not shown to preserve the clarity of the drawing for discussion of the other features. Product to be de-watered in centrifuge 10 is introduced in the direction of the viewer of FIG. 2 by loading conveyor 12. Gravity will cause the product to fall off the end of conveyor 12 in a direction "B" and if centrifuge tube 26 is rotating, the product will distribute itself evenly on the inside surface of centrifuge tube 26. By adjusting the depth of insertion of conveyor 12 into centrifuge tube 26, the product can be distributed along several tracks along the inside length of centrifuge tube 26.

Alternatively, a system of spray nozzles 46 may be included along the axial length inside liner 39 to provide one or more rinse cycles of the product after loading. The same nozzle configuration may be used for injecting liquid substances that are to be filtered.

The external axles 44 supporting the centrifuge tube are preferably mounted in bearings fixed inside structural support tube 20, which is itself slightly larger in diameter than the centrifuge tube 26. The structural support tube 20 is equipped with lateral trunnions, permitting the entire assembly to be rotated from the horizontal position to a vertical position. The outer containment shells 16 and 18 cover the structural support tube 20 and contain any centrifugally expelled liquid. A hose 48 may be included to guide away waste liquid.

FIG. 3A illustrates that before loading, centrifuge tube 26 is horizontally positioned and rotated at a minimum rate sufficient for centrifugal force to hold product to be de-watered to the interior wall as it falls from the loading conveyor 12.

Figure 3B:
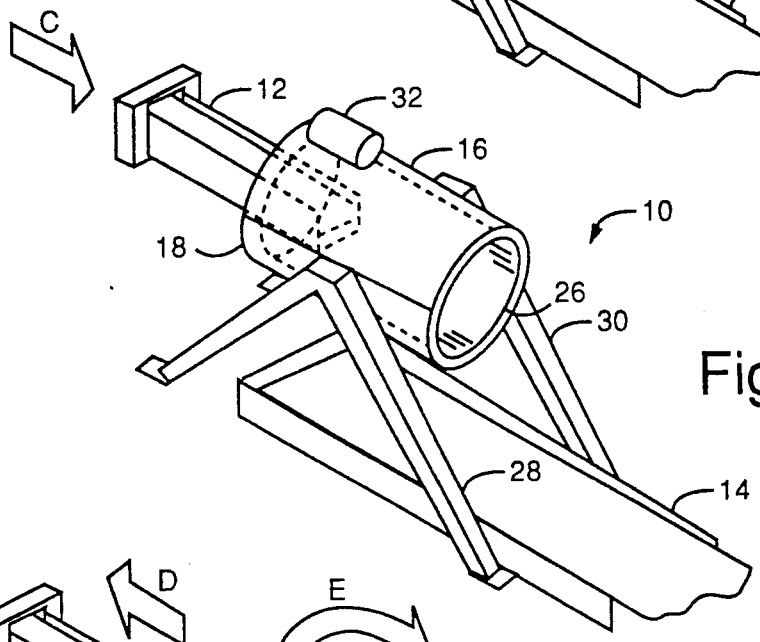
FIG. 3B is a perspective view of the centrifuge of FIG. 1 in a product loading condition.
Figure 3C:
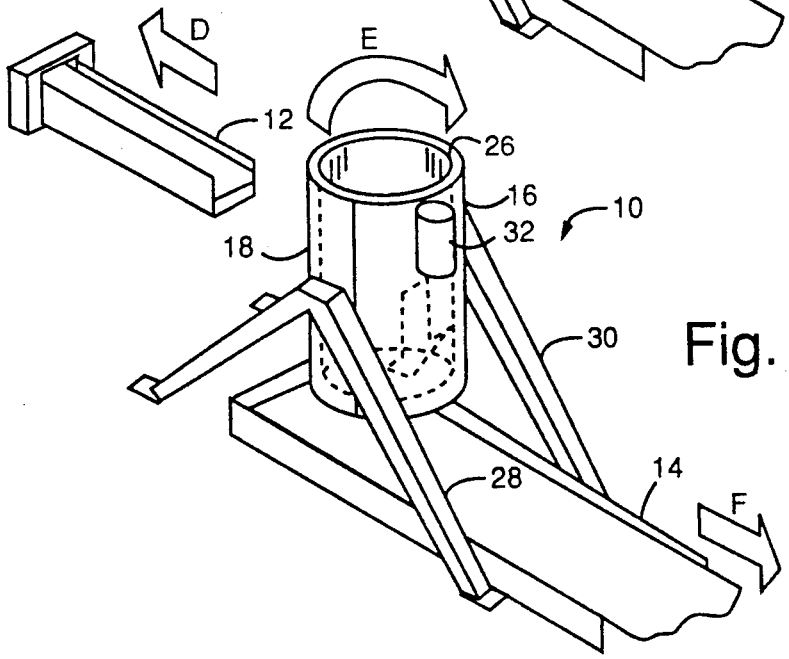
FIG. 3C is a perspective view of the centrifuge of FIG. 1 in a spin-drying condition, and when the spin basket is decelerated, in a product unloading condition.

Loading is accomplished by causing static traveling conveyor 12 to be engulfed, as shown in FIG. 3B with a direction "C", by centrifuge tube 26 and liner 39 which are rotating at a "loading speed". Initially, the end of conveyor 12 is stopped just short of reaching opening 34, and then is backed out in a direction "D" (FIG. 3C). Centrifuge tube 26 is continued to be rotated (in direction "A", FIG. 2) at its loading speed, and is simultaneously withdrawn from conveyor 12 in direction "D" while depositing product in a spiral track or stepped layers to form a layer typically three inches thick on the inside surface of centrifuge tube 26, or liner 39, if so equipped. The speed of rotation is preferably adjusted by motor 32 to have only the minimum centrifugal force required to just hold the wet material to the wall, while still allowing it to slide or shift slightly to build a uniform layer. The thickness of the accumulated load of product may thus be controlled by the rate of withdrawal, and/or the number of in and out deposition cycles involving loading conveyor 12.

When product has been deposited to a desired thickness and the traveling conveyor 12 is fully withdrawn in direction "D", the cylindrical basket speed of centrifuge tube 26 is increased to a "drying speed", to expel water or other liquid from the product. Simultaneously, the exterior cylinder assembly is pivoted in a direction "E" from its horizontal loading position to its vertical unloading position, as shown in FIG. 3C. During the de-watering and axis position change, the expelled water or other liquid gathers inside the containment shell and may be carried away to a tank or drain through hose 48 (shown only in FIG. 2).

Upon completion of the de-watering, the speed of rotation of centrifuge 26 is reduced until the force of gravity exceeds the centrifugal force, at which point the de-watered product will fall out to conveyor 14 and moves away in a direction "F". The rotation may also be completely stopped.

When empty, the rotating speed may be increased slightly (for loading) and the complete cylinder assembly is pivoted back to the horizontal position of FIG. 3B for reloading, thus making ready for a new cycle.

To eliminate a significant amount of direct labor involvement, all of the operating functions described herein may be controlled by a conventional programmable controller, with the possible exception of the start/stop commands.

Preferably, centrifuge 10 comprises materials that are USDA approved food-grade polypropylene, for all the parts that normally come in contact with the food product. Such a plastic greatly reduces the weight of centrifuge 10, compared to that of conventional machines for similar production capacities. Motor power requirements for de-watering are also substantially reduced.

Figure 4:
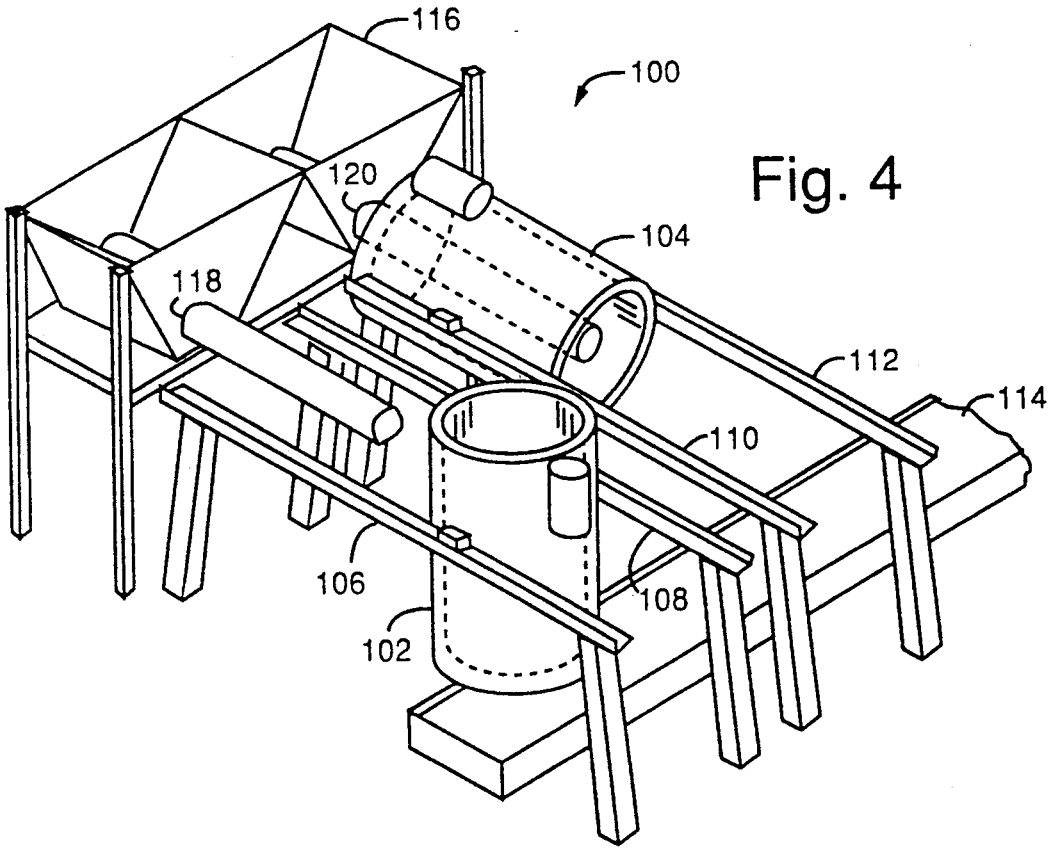
FIG. 4 is a perspective view of a tandem centrifuge embodiment of the present invention.

FIG. 4 illustrates a tandem centrifuge embodiment of the present invention, referred to herein by the general reference numeral 100. Tandem centrifuge 100 comprises a pair of spin-dry units 102 and 104 that are similar to the corresponding pieces of centrifuge 10 in FIGS. 1 and 2. Tandem centrifuge 100 further comprises a pair of tracks 106 and 108 for unit 102 to slide back and forth on, a pair of tracks 110 and 112 for unit 104 to slide back and forth on, a common unloading conveyor 114, a double vault loading bin 116, and a pair of product loaders 118 and 120. Spin-dry unit 104 is shown in its horizontal position for product loading and is fully forward toward bin 116 on tracks 110 and 112 so that loader 120 is inserted to its maximum limit. Spin-dry unit 102 is shown in its vertical position which can be used to bring the centrifuge tube up to drying speed for de-watering. The vertical position is also used for unloading by decelerating the centrifuge tube to an unloading speed, e.g., stopped, and allowing de-watered product to drop by gravity onto conveyor 114. Loaders 118 and 120 may comprise augers in pipes, flumes, simple pipes or hoses to transport the product from the bin 116 to the spin-dryer unit 102 and 104. The tandem centrifuge 100 has the advantage of near continuous processing capability, because loading, drying and unloading can be carried on in parallel. Although only two spin-dryer units have been shown in tandem, the invention is not so limited, and any number of spin dry units could be assembled to share bin 116 and conveyor 114.

In general, the present invention involves a method for removing liquids that have coated or infiltrated the material of a solid product. The method can be summarized as comprising a spinning cylindrical sieve on a horizontal axis at a "loading" speed of rotation that is just sufficient to press the product against the inside walls of the sieve by centrifugal force. Then, transporting the solid product to a plurality of points inside the rotating sieve such that the product drops by gravity to a spiral track of points on the inside surface of the rotating sieve such that the product is uniformly deposited. Once that is completed, then the spinning of the cylindrical sieve is accelerated to a "drying" speed of rotation that is just sufficient to cause the liquid to migrate out of the product through the inside walls of the sieve by centrifugal force. The rotating cylindrical sieve is then pivoted such that its axis of rotation is approximately vertical. The spinning of the cylindrical sieve is then decelerated to an "unloading" speed of rotation that is slow enough to cause the product to drop out of the sieve by force of gravity.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A centrifuge, comprising:

a non-spinning housing with swivels that allow an open-end of the housing to face vertical down or horizontal;

a rotatable inner liner disposed within the housing and having an open end concentric with the open end of the housing;

product introduction means positioned for transporting a product horizontally to a variety of points along an inside length of the inner liner while it and the housing are in a horizontal attitude;

motor means connected to rotate the inner liner at a plurality of speeds including a loading speed, a drying speed that is substantially faster than said loading speed and sufficient to cause dewatering of said product substantially by operation of centrifugal force and an unloading speed that is substantially slower than said drying speed and that permits said product to drop out by gravity from the inner liner when said open end is facing vertically downward; and swiveling means for positioning the housing in a horizontal attitude for a loading of said product while the inner liner is spinning at said loading speed and a vertical attitude for an unloading of said product while the inner liner is spinning at said unloading speed.

2. The centrifuge of claim 1, wherein:

the inner liner comprises a plastic link and pin construction of a conveyor belting system turned inside-out such that drive to spin the liner may be applied from outside the perimeter of the liner.

3. The centrifuge of claim 1, further comprising:

a tubular sieve for preventing said product from contaminating the fabric of the inner liner and that allows liquid water to pass through.

4. The centrifuge of claim 3, wherein:

the tubular sieve comprises a plastic cylinder with a matrix of one-sixteenth inch holes.

5. The centrifuge of claim 3, wherein:

the tubular sieve comprises a cloth material.

6. The centrifuge of claim 3, wherein:

the tubular sieve comprises a cloth material and said product includes milk curds and whey such that said cloth material provides a screen to pass said whey by centrifugal force and may retain said curd.

7. The centrifuge of claim 3, wherein:

the tubular sieve comprises a filter paper material.

8. The centrifuge of claim 1, further comprising:

a system of rinsing nozzles to direct a rinse spray from within the inner liner for washing said product.

9. The centrifuge of claim 1, further comprising:

a plurality of sprockets that surround, engage and support the inner liner; and a plastic link and pin conveyor belting system turned right side-out and surrounding and engaging at least one complete ring of the plurality of sprockets such that drive to spin the liner may be applied to the perimeter of the liner uniformly about the perimeter of the inner liner.

10. A centrifuge, comprising:

a cylindrical non-rotating housing with two opposite open ends;

a perforated-surface right-circular-cylinder sleeve with two opposite open ends disposed within the cylindrical housing;

bearing means for allowing the sleeve to rotate within the housing;

motor means connected to rotate the sleeve at a plurality of speeds including a loading speed, a drying speed that is substantially faster than said loading speed and sufficient to cause dewatering of a material substantially by operation of centrifugal force and an unloading speed that is substantially slower than said drying speed and that permits said material to drop out by gravity from the inner liner when positioned in the vertical;

axial-flow conveyor means for horizontally depositing a substantially uniform layer of said material to be de-watered on said perforated surface of the sleeve from one of said open ends in the housing; and de-watered material unloading means for tilting the centrifuge such that one of said open ends may be positioned to allow said deposited material to fall out of the centrifuge.

11. The centrifuge of claim 10, wherein:

the unloading means includes a pair of trunnions mounted on the housing and a motor to rotate the housing between a vertical orientation and a horizontal orientation wherein said opposite open ends may be placed one vertically above another and alternatively at equal elevations.

12. The centrifuge of claim 11, wherein:

the unloading means further includes a motor controller for starting and stopping the motor means, wherein the sleeve may be stopped from rotating after the housing has been rotated into said vertical orientation, thereby canceling a centrifugal force that would otherwise hold said deposited material inside the sleeve regardless of its orientation.

13. The centrifuge of claim 10, wherein:

the cylindrical sleeve comprises a plastic sieve and a plurality of expansion hoops for holding out and maintaining a circular inner diameter of the sleeve and for pressing an engagement of the sleeve with the bearing means.

14. The centrifuge of claim 10, wherein:

the bearing means comprises a chain-linked conveyor belt mat connected to itself in a continuous cylindrical loop within which the sleeve is disposed and further comprising a system of sprockets mounted within the housing on axes parallel to a common axis of both the housing and sleeve wherein said sprockets are positively engaged with said conveyor belt mat and sleeve and couple-in power drive from the motor means to forcibly rotate the sleeve within the housing.

15. The centrifuge of claim 10, wherein:

the axial-flow conveyor means comprises a tube and auger with a loading-end and a discharging-end for moving said material from said loading-end to said discharging-end where said material can fall inside the sleeve.

16. The centrifuge of claim 15, wherein:

the axial-flow conveyor means further comprises insertion means for moving said discharging-end into and out of one of said open ends of the housing and inside the sleeve while the sleeve is rotating.

17. The centrifuge of claim 16, wherein:

said insertion means includes a linear motion sensor and controller for moving said discharging-end at a rate that permits a uniform thickness of said material to be deposited inside the sleeve while the motor means is rotating the sleeve within the housing.

18. A centrifuge, comprising:

a cylindrical non-rotating housing with two opposite open ends;

a perforated-surface open-ended right-circular-cylinder sleeve disposed within the cylindrical housing the cylindrical sleeve and including a plastic sieve and a plurality of expansion hoops for maintaining a circular inner diameter of the sleeve;

bearing means for allowing the sleeve to rotate within the housing and including a chain-linked conveyor belt mat connected to itself in a continuous cylindrical loop within which the sleeve is disposed and further comprising a system of sprockets mounted within the housing on axes parallel to a common axis of both the housing and sleeve wherein said sprockets are positively engaged with said conveyor belt mat and sleeve and couple-in power drive to forcibly rotate the sleeve within the housing;

motor means for rotating the sleeve within the housing through said sprockets and said chain-linked conveyor belt mat;

axial-flow conveyor means for horizontally depositing a substantially uniform layer of material to be de-watered on said perforated surface of the sleeve inside from one of said open ends in the housing, the conveyer means further comprising a tube and auger with a loading-end and a discharging-end for moving said material from said loading-end to said discharging-end where said material can fall inside the sleeve;

insertion means for moving said discharging-end into and out of one of said open ends of the housing and inside the sleeve while the sleeve is rotating;

a linear motion controller for moving said discharging-end at a rate that permits a uniform thickness of said material to be deposited inside the sleeve while the motor means is rotating the sleeve within the housing;

de-watered-material unloading means for tilting the centrifuge such that one of said open ends may be positioned to allow said deposited material to fall out of the centrifuge, and including a pair of trunnions mounted on the housing and a motor to rotate the housing between a vertical orientation and a horizontal orientation wherein said opposite open ends may be placed one vertically above another and alternatively at equal elevations; and a motor controller for starting and stopping the motor means, wherein the sleeve may be stopped from rotating after the housing has been rotated into said vertical orientation, thereby canceling a centrifugal force that would otherwise hold said deposited material inside the sleeve regardless of its orientation.

19. A tandem centrifuge system, comprising:

a hopper bin for receiving input material to be centrifuged;

a first horizontal delivery system for transporting a portion of said material to be centrifuged from the hopper bin to a point "A";

a second horizontal delivery system for transporting a portion of said material to be centrifuged from the hopper bin to a point "B";

a first centrifuge unit including an rotatable inner liner; a motor drive for rotating said rotatable inner liner at a loading speed, a drying speed greater than the loading speed and an unloading speed less than said drying speed; an outer liquid containment housing; a pivoting means for pivoting the first centrifuge unit to a horizontal axis of rotation of said inner liner and a sliding means for moving the first centrifuge unit horizontally along the direction of said rotation of said inner liner such that said point "A" may be engulfed by a variable amount by an inside length of said inner liner;

a second centrifuge unit including an rotatable inner liner; a motor drive for rotating said rotatable inner liner at a loading speed, a drying speed greater than the loading speed and an unloading speed less than said drying speed; an outer liquid containment housing; a pivoting means for pivoting the second centrifuge unit to a horizontal axis of rotation of said inner liner and a sliding means for moving the second centrifuge unit horizontally along the direction of said rotation of said inner liner such that said point "B" may be engulfed by a variable amount by an inside length of said inner liner;

first unloading means for withdrawing the first centrifuge unit clear of point "A" and for pivoting the first centrifuge unit to a vertical orientation and for decelerating said rotatable inner liner such that gravity may cause said material to be centrifuged to drop out of said inner liner by force of gravity; and second unloading means for withdrawing the second centrifuge unit clear of point "B" and for pivoting the second centrifuge unit to a vertical orientation and for decelerating said rotatable inner liner such that gravity may cause said material to be centrifuged to drop out of said inner liner by force of gravity.

20. The system of claim 19, wherein:

said inner liner comprises a plastic link and pin construction of a conveyor belting system turned inside-out such that motor drive to spin the liner lay be applied from outside a perimeter of said inner liner.

21. A method for removing liquids that have coated or infiltrated the material of a solid product, the method comprising the steps of:

spinning a cylindrical sieve on a horizontal axis at a "loading" speed of rotation that is just sufficient to press said product against the inside walls of said sieve by centrifugal force and maintain contact within said sieve through each full rotation;

transporting said solid product to a plurality of points inside said rotating sieve such that said product drops by gravity to a spiral track of points on the inside surface of said rotating sieve such that said product is uniformly deposited;

accelerating the spinning of said cylindrical sieve to a "drying" speed of rotation that is just sufficient to centrifugally force said liquid to migrate out of said product through the walls of said sieve;

pivoting said rotating cylindrical sieve such that its axis of rotation is approximately vertical while maintaining said drying speed of rotation of said sieve; and decelerating the spinning of said cylindrical sieve to an "unloading" speed of rotation that is slow enough to permit said product to drop vertically out of said sieve by force of gravity.

22. A centrifuge, comprising:

a cylindrical non-rotating housing with two opposite open ends;

a perforated-surface open-ended right-circular-cylinder sleeve disposed within the cylindrical housing;

bearing means for allowing the sleeve to rotate within the housing comprising a chain-linked conveyor belt mat connected to itself in a continuous cylindrical loop within which the sleeve is disposed and further comprising a system of sprockets mounted within the housing on axes parallel to a common axis of both the housing and sleeve wherein said sprockets are positively engaged with said conveyor belt mat and sleeve and couple-in power drive from the motor means to forcibly rotate the sleeve within the housing;

motor means for rotating the sleeve within the housing;

axial-flow conveyor means for horizontally depositing a substantially uniform layer of material to be de-watered on said perforated surface of the sleeve from one of said open ends in the housing; and de-watered material unloading means for tilting the centrifuge such that one of said open ends may be positioned to allow said deposited material to fall out of the centrifuge.

23. A centrifuge, comprising:

a cylindrical non-rotating housing with two opposite open ends;

a perforated-surface open-ended right-circular-cylinder sleeve disposed within the cylindrical housing;

bearing means for allowing the sleeve to rotate within the housing;

motor means for rotating the sleeve within the housing;

axial-flow conveyor means, comprising a tube and auger with a loading-end and a discharging-end for moving said material from said loading-end to said discharging-end where said material can fall inside the sleeve, insertion means for moving said discharging-end into and out of one of said open ends of the housing and inside the sleeve while the sleeve is rotating, said insertion means including a linear motion sensor and controller for moving said discharging-end at a rate that permits a uniform thickness of said material to be deposited inside the sleeve while the motor means is rotating the sleeve within the housing, for horizontally depositing a substantially uniform layer of material to be de-watered on said perforated surface of the sleeve from one of said open ends in the housing; and de-watered material unloading means for tilting the centrifuge such that one of said open ends may be positioned to allow said deposited material to fall out of the centrifuge.

* * * * *